US008034463B2

(12) United States Patent
Leimbach et al.

(10) Patent No.: US 8,034,463 B2
(45) Date of Patent: Oct. 11, 2011

(54) FIBROUS STRUCTURES

(75) Inventors: Angela Marie Leimbach, Hamilton, OH (US); Michael Scott Prodoehl, West Chester, OH (US); John Allen Manifold, Milan, IN (US)

(73) Assignee: The Procter & Gamble Company, Cincinnati, OH (US)

( * ) Notice: Subject to any disclaimer, the term of this patent is extended or adjusted under 35 U.S.C. 154(b) by 83 days.

(21) Appl. No.: 12/512,176

(22) Filed: Jul. 30, 2009

(65) Prior Publication Data

US 2011/0027596 A1 Feb. 3, 2011

(51) Int. Cl.
*D21H 21/20* (2006.01)

(52) U.S. Cl. ..... 428/537.5; 428/534; 526/304; 526/307.5; 526/315; 604/358; 162/158; 162/164.1; 162/168.1

(58) Field of Classification Search ..... 428/537.5, 428/534; 162/158, 164.1, 168.1; 526/304, 526/307.5, 315; 604/358
See application file for complete search history.

(56) References Cited

U.S. PATENT DOCUMENTS

| | | | | |
|---|---|---|---|---|
| 6,241,853 | B1 * | 6/2001 | Smith et al. | 162/141 |
| 7,125,469 | B2 * | 10/2006 | Barcus et al. | 162/123 |
| 7,217,339 | B2 * | 5/2007 | Mohammadi et al. | 162/158 |
| 7,811,665 | B2 * | 10/2010 | Manifold et al. | 428/326 |
| 2004/0221975 | A1 * | 11/2004 | Hernandez-Munoa et al. | 162/135 |
| 2005/0067126 | A1 * | 3/2005 | Horenziak et al. | 162/109 |

FOREIGN PATENT DOCUMENTS

| | | | |
|---|---|---|---|
| EP | 1 004 703 | A1 | 5/2000 |
| EP | 1004703 | * | 5/2000 |
| WO | WO99/63158 | * | 12/1999 |
| WO | WO 99/63158 | A1 | 12/1999 |
| WO | WO2004/072372 | * | 8/2004 |
| WO | WO 2004/072372 | A1 | 8/2004 |
| WO | WO2008/047299 | * | 4/2008 |
| WO | WO 2008/047299 | A2 | 4/2008 |
| WO | WO 2009/095807 | A2 | 8/2009 |

OTHER PUBLICATIONS

PCT International Search Report Mailed Nov. 22, 2010.

* cited by examiner

*Primary Examiner* — Leszek Kiliman
(74) *Attorney, Agent, or Firm* — C. Brant Cook

(57) ABSTRACT

Fibrous structures that exhibit a Wet Burst of greater than 30 g as measured according to the Wet Burst Test Method and that may also exhibit a Geometric Mean ("GM") Modulus and/or CD Modulus of less than 1320 at 15 g/cm and/or less than 875 at 15 g/cm as measured according to the Modulus Test Method are provided.

31 Claims, 7 Drawing Sheets

FIBROUS STRUCTURES

FIELD OF THE INVENTION

The present invention relates to fibrous structures that exhibit a Wet Burst of greater than 30 g as measured according to the Wet Burst Test Method, and more particularly to such fibrous structures that also exhibit a Geometric Mean Modulus of less than 1320 at 15 g/cm and/or less than 875 at 15 g/cm as measured according to the Modulus Test Method.

BACKGROUND OF THE INVENTION

Fibrous structures, particularly sanitary tissue products comprising fibrous structures, are known to exhibit different values for particular properties. These differences may translate into one fibrous structure being softer or stronger or more absorbent or more flexible or less flexible or exhibit greater stretch or exhibit less stretch, for example, as compared to another fibrous structure.

One property of fibrous structures, for example facial tissue, that is desirable to consumers is the Wet Burst of the fibrous structure. It has been found that at least some consumers desire fibrous structures that exhibit a Wet Burst of greater than 30 g and/or greater than 95 g as measured according to the Wet Burst Test Method described herein so long as the fibrous structures exhibit a Geometric Mean Modulus of less than 1320 at 15 g/cm and/or less than 865 at 15 g/cm and/or a CD Modulus of less than 1320 at 15 g/cm and/or less than 875 at 15 g/cm and/or less than 710 at 15 g/cm as measured according to the Modulus Test Method described herein.

Accordingly, there exists a need for fibrous structures that exhibit a Wet Burst of greater than 30 g as measured according to the Wet Burst Test Method and a Geometric Mean Modulus of less than 1320 at 15 g/cm and/or a CD Modulus of less than 1320 at 15 g/cm as measured according to the Modulus Test Method.

SUMMARY OF THE INVENTION

The present invention fulfills the need described above by providing fibrous structures that exhibit a Wet Burst of greater than 30 g as measured according to the Wet Burst Test Method and a Geometric Mean Modulus of less than 1320 at 15 g/cm and/or a CD Modulus of less than 1320 at 15 g/cm as measured according to the Modulus Test Method.

In one example of the present invention, a fibrous structure that exhibits a Geometric Mean Modulus of less than 865 at 15 g/cm as measured according to the Modulus Test Method and a Wet Burst of from greater than 30 g to less than 355 g as measured according to the Wet Burst Test Method, is provided.

In another example of the present invention, a fibrous structure that exhibits a Geometric Mean Modulus of less than 1320 at 15 g/cm as measured according to the Modulus Test Method and a Wet Burst of from greater than 95 g to less than 355 g as measured according to the Wet Burst Test Method, is provided.

In yet another example of the present invention, a multi-ply fibrous structure that exhibits a Geometric Mean Modulus of less than 865 at 15 g/cm as measured according to the Modulus Test Method and a Wet Burst of from greater than 30 g as measured according to the Wet Burst Test Method, is provided.

In even yet another example of the present invention, a multi-ply fibrous structure that exhibits a Geometric Mean Modulus of less than 1320 at 15 g/cm as measured according to the Modulus Test Method and a Wet Burst of from greater than 95 g as measured according to the Wet Burst Test Method, is provided.

In still yet another example of the present invention, a fibrous structure that exhibits a CD Modulus of less than 710 at 15 g/cm as measured according to the Modulus Test Method and a Wet Burst of from greater than 30 g as measured according to the Wet Burst Test Method, is provided.

In yet another example of the present invention, a fibrous structure that exhibits a Geometric Mean Modulus of less than 875 at 15 g/cm as measured according to the Modulus Test Method and a Wet Burst of from greater than 30 g to less than 175 g as measured according to the Wet Burst Test Method, is provided.

In even still yet another example of the present invention, a multi-ply fibrous structure that exhibits a Geometric Mean Modulus of less than 875 at 15 g/cm as measured according to the Modulus Test Method and a Wet Burst of from greater than 30 g as measured according to the Wet Burst Test Method, is provided.

In even still yet another example of the present invention, a multi-ply fibrous structure that exhibits a Geometric Mean Modulus of less than 1320 at 15 g/cm as measured according to the Modulus Test Method and a Wet Burst of from greater than 95 g as measured according to the Wet Burst Test Method, is provided.

Accordingly, the present invention provides fibrous structures that exhibit a Wet Burst and a Geometric Mean Modulus and/or CD Modulus that consumers desire.

DETAILED DESCRIPTION OF THE INVENTION

Definitions

Figure 1:
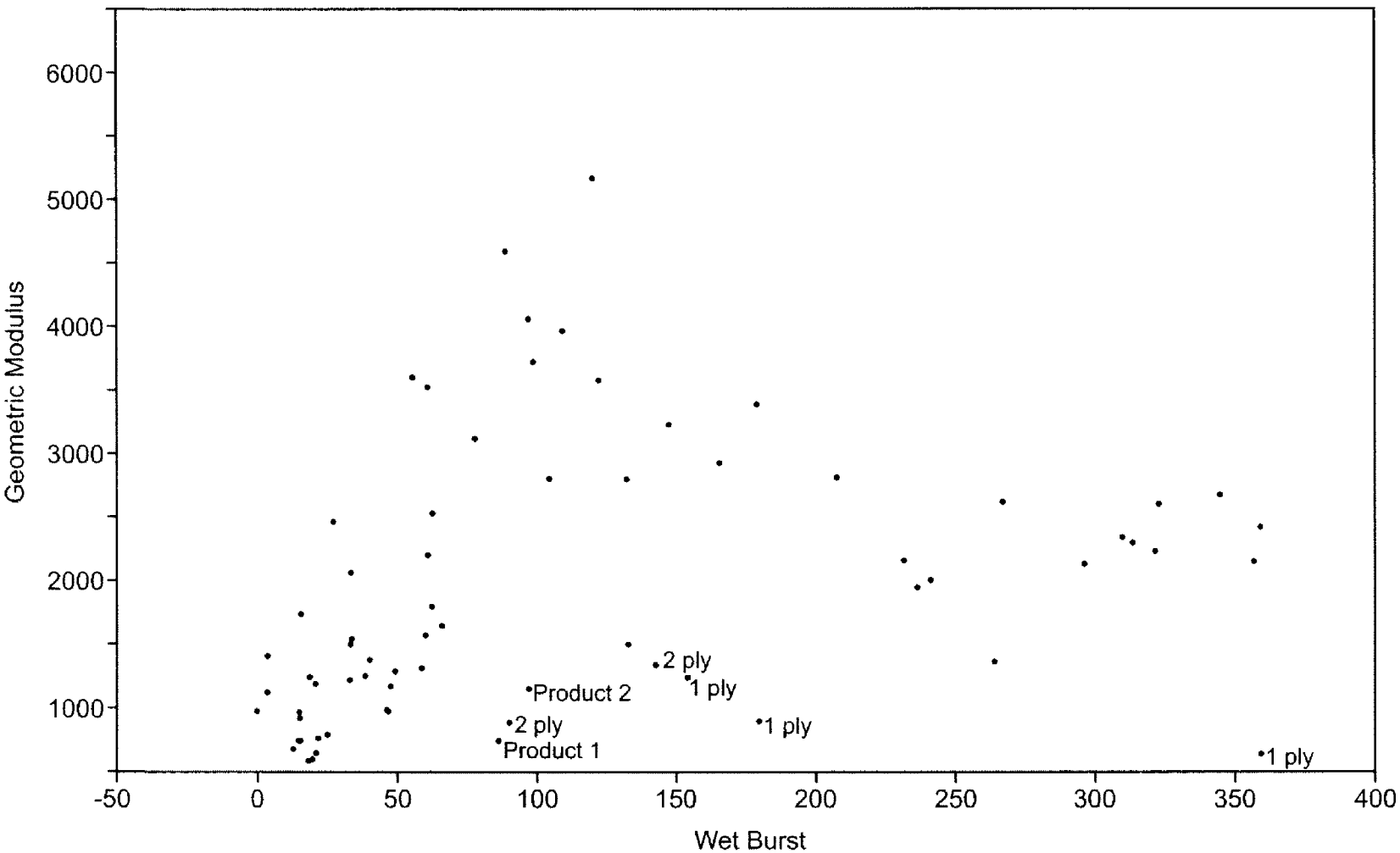
FIG. 1 is a plot of Geometric Mean Modulus to Wet Burst for fibrous structures of the present invention and commercially available fibrous structures, both single-ply and multi-ply sanitary tissue products.

"Fibrous structure" as used herein means a structure that comprises one or more filaments and/or fibers. In one example, a fibrous structure according to the present invention means an orderly arrangement of filaments and/or fibers within a structure in order to perform a function. Nonlimiting examples of fibrous structures of the present invention include paper, fabrics (including woven, knitted, and nonwoven), and absorbent pads (for example for diapers or feminine hygiene products).

Nonlimiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous slurry is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

The fibrous structures of the present invention may be homogeneous or may be layered. If layered, the fibrous structures may comprise at least two and/or at least three and/or at least four and/or at least five layers.

The fibrous structures of the present invention may be co-formed fibrous structures.

"Co-formed fibrous structure" as used herein means that the fibrous structure comprises a mixture of at least two different materials wherein at least one of the materials comprises a filament, such as a polypropylene filament, and at least one other material, different from the first material, comprises a solid additive, such as a fiber and/or a particulate. In one example, a co-formed fibrous structure comprises solid additives, such as fibers, such as wood pulp fibers, and filaments, such as polypropylene filaments.

"Solid additive" as used herein means a fiber and/or a particulate.

"Particulate" as used herein means a granular substance or powder.

"Fiber" and/or "Filament" as used herein means an elongate particulate having an apparent length greatly exceeding its apparent width, i.e. a length to diameter ratio of at least about 10. In one example, a "fiber" is an elongate particulate as described above that exhibits a length of less than 5.08 cm and a "filament" is an elongate particulate as described above that exhibits a length of greater than or equal to 5.08 cm.

Fibers are typically considered discontinuous in nature. Nonlimiting examples of fibers include wood pulp fibers and synthetic staple fibers such as polyester fibers.

Filaments are typically considered continuous or substantially continuous in nature. Filaments are relatively longer than fibers. Nonlimiting examples of filaments include meltblown and/or spunbond filaments. Nonlimiting examples of materials that can be spun into filaments include natural polymers, such as starch, starch derivatives, cellulose and cellulose derivatives, hemicellulose, hemicellulose derivatives, and synthetic polymers including, but not limited to polyvinyl alcohol filaments and/or polyvinyl alcohol derivative filaments, and thermoplastic polymer filaments, such as polyesters, nylons, polyolefins such as polypropylene filaments, polyethylene filaments, and biodegradable or compostable thermoplastic fibers such as polylactic acid filaments, polyhydroxyalkanoate filaments and polycaprolactone filaments. The filaments may be monocomponent or multicomponent, such as bicomponent filaments.

In one example of the present invention, "fiber" refers to papermaking fibers. Papermaking fibers useful in the present invention include cellulosic fibers commonly known as wood pulp fibers. Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

In addition to the various wood pulp fibers, other cellulosic fibers such as cotton linters, rayon, lyocell and bagasse can be used in this invention. Other sources of cellulose in the form of fibers or capable of being spun into fibers include grasses and grain sources.

"Sanitary tissue product" as used herein means a soft, low density (i.e. <about 0.15 g/cm3) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

In one example, the sanitary tissue product of the present invention comprises a fibrous structure according to the present invention.

The sanitary tissue products and/or fibrous structures of the present invention may exhibit a basis weight of greater than 15 g/m2 to about 120 g/m2 and/or from about 15 g/m2 to about 110 g/m2 and/or from about 20 g/m2 to about 100 g/m2 and/or from about 30 to about 90 g/m2. In addition, the sanitary tissue products and/or fibrous structures of the present invention may exhibit a basis weight between about 40 g/m2 to about 120 g/m2 and/or from about 50 g/m2 to about 110 g/m2 and/or from about 55 g/m2 to about 105 g/m2 and/or from about 60 g/m2 to 100 g/m2.

The sanitary tissue products of the present invention may exhibit an initial total wet tensile strength of less than about 78 g/cm and/or less than about 59 g/cm and/or less than about 39 g/cm and/or less than about 29 g/cm.

The sanitary tissue products of the present invention may exhibit an initial total wet tensile strength of greater than about 118 g/cm and/or greater than about 157 g/cm and/or greater than about 196 g/cm and/or greater than about 236 g/cm and/or greater than about 276 g/cm and/or greater than about 315 g/cm and/or greater than about 354 g/cm and/or greater than about 394 g/cm and/or from about 118 g/cm to about 1968 g/cm and/or from about 157 g/cm to about 1181 g/cm and/or from about 196 g/cm to about 984 g/cm and/or from about 196 g/cm to about 787 g/cm and/or from about 196 g/cm to about 591 g/cm.

The sanitary tissue products of the present invention may exhibit a density (measured at 95 g/in2) of less than about 0.60 g/cm3 and/or less than about 0.30 g/cm3 and/or less than about 0.20 g/cm3 and/or less than about 0.10 g/cm3 and/or less than about 0.07 g/cm3 and/or less than about 0.05 g/cm3 and/or from about 0.01 g/cm3 to about 0.20 g/cm3 and/or from about 0.02 g/cm3 to about 0.10 g/cm3.

The sanitary tissue products of the present invention may be in the form of sanitary tissue product rolls. Such sanitary tissue product rolls may comprise a plurality of connected, but perforated sheets of fibrous structure, that are separably dispensable from adjacent sheets. Alternatively, the sanitary tissue products of the present invention may be in the form of discrete sheets, such as a stack of facial tissues.

The sanitary tissue products of the present invention may comprises additives such as softening agents, temporary wet strength agents, permanent wet strength agents, bulk softening agents, lotions, silicones, wetting agents, latexes, especially surface-pattern-applied latexes, dry strength agents such as carboxymethylcellulose and starch, and other types of additives suitable for inclusion in and/or on sanitary tissue products.

"Weight average molecular weight" as used herein means the weight average molecular weight as determined using gel permeation chromatography according to the protocol found in Colloids and Surfaces A. Physico Chemical & Engineering Aspects, Vol. 162, 2000, pg. 107-121.

"Basis Weight" as used herein is the weight per unit area of a sample reported in lbs/3000 ft2 or g/m2 and is measured according to the Basis Weight Test Method described herein.

"Caliper" as used herein means the macroscopic thickness of a fibrous structure. Caliper is measured according to the Caliper Test Method described herein.

"Basis Weight Ratio" as used herein is the ratio of low basis weight portion of a fibrous structure to a high basis weight portion of a fibrous structure. In one example, the fibrous structures of the present invention exhibit a basis weight ratio of from about 0.02 to about 1. In another example, the basis weight ratio of the basis weight of a linear element of a fibrous structure to another portion of a fibrous structure of the present invention is from about 0.02 to about 1.

"Geometric Mean ("GM") Modulus" as used herein is determined as described in the Modulus Test Method described herein.

"CD Modulus" as used herein is determined as described in the Modulus Test Method described herein.

"Machine Direction" or "MD" as used herein means the direction parallel to the flow of the fibrous structure through the fibrous structure making machine and/or sanitary tissue product manufacturing equipment.

"Cross Machine Direction" or "CD" as used herein means the direction parallel to the width of the fibrous structure making machine and/or sanitary tissue product manufacturing equipment and perpendicular to the machine direction.

"Ply" as used herein means an individual, integral fibrous structure.

"Plies" as used herein means two or more individual, integral fibrous structures disposed in a substantially contiguous, face-to-face relationship with one another, forming a multi-ply fibrous structure and/or multi-ply sanitary tissue product. It is also contemplated that an individual, integral fibrous structure can effectively form a multi-ply fibrous structure, for example, by being folded on itself.

"Linear element" as used herein means a discrete, unidirectional, uninterrupted portion of a fibrous structure having length of greater than about 4.5 mm. In one example, a linear element may comprise a plurality of non-linear elements In one example, a linear element in accordance with the present invention is water-resistant. Unless otherwise stated, the linear elements of the present invention are present on a surface of a fibrous structure. The length and/or width and/or height of the linear element and/or linear element forming component within a molding member, which results in a linear element within a fibrous structure, is measured by the Dimensions of Linear Element/Linear Element Forming Component Test Method described herein.

In one example, the linear element and/or linear element forming component is continuous or substantially continuous with a useable fibrous structure, for example in one case one or more 11 cm×11 cm sheets of fibrous structure.

"Discrete" as it refers to a linear element means that a linear element has at least one immediate adjacent region of the fibrous structure that is different from the linear element.

"Unidirectional" as it refers to a linear element means that along the length of the linear element, the linear element does not exhibit a directional vector that contradicts the linear element's major directional vector.

"Uninterrupted" as it refers to a linear element means that a linear element does not have a region that is different from the linear element cutting across the linear element along its length. Undulations within a linear element such as those resulting from operations such creping and/or foreshortening are not considered to result in regions that are different from the linear element and thus do not interrupt the linear element along its length.

"Water-resistant" as it refers to a linear element means that a linear element retains its structure and/or integrity after being saturated.

"Substantially machine direction oriented" as it refers to a linear element means that the total length of the linear element that is positioned at an angle of greater than 45° to the cross machine direction is greater than the total length of the linear element that is positioned at an angle of 45° or less to the cross machine direction.

"Substantially cross machine direction oriented" as it refers to a linear element means that the total length of the linear element that is positioned at an angle of 45° or greater to the machine direction is greater than the total length of the linear element that is positioned at an angle of less than 45° to the machine direction.

Fibrous Structure

The fibrous structures of the present invention may be a single-ply or multi-ply fibrous structure.

In one example of the present invention as shown in FIG. 1, a fibrous structure exhibits a GM Modulus of less than 865 and/or less than 800 and/or less than 750 at 15 g/cm as measured according to the Modulus Test Method.

In another example of the present invention as shown in FIG. 1, a fibrous structure exhibits a GM Modulus of less than 1320 and/or less than 1250 and/or less than 1150 at 15 g/cm as measured according to the Modulus Test Method.

In another example of the present invention as shown in FIG. 1, a fibrous structure exhibits a Wet Burst of greater than 30 g to less than 355 g and/or from about 50 g to about 300 g and/or from about 70 g to about 200 g as measured according to the Wet Burst Test Method. In another example of the present invention as shown in FIG. 1, a fibrous structure exhibits a Wet Burst of greater than 95 g to less than 355 and/or greater than 95 g to about 300 g and/or greater than 95 g to about 200 g as measured according to the Wet Burst Test Method.

In another example of the present invention as shown in FIG. 1, a multi-ply fibrous structure exhibits a Wet Burst of greater than 30 g and/or from about 50 g to about 1000 g and/or from about 70 g to about 300 g as measured according to the Wet Burst Test Method. In yet another example of the present invention as shown in FIG. 1, a multi-ply fibrous structure exhibits a Wet Burst of greater than 95 g and/or greater than 95 g to about 1000 g and/or greater than 95 g to about 300 g as measured according to the Wet Burst Test Method.

In one example of the present invention, a fibrous structure exhibits a Wet Burst of greater than 30 g to less than 355 g and/or from about 50 g to about 300 g and/or from about 70 g to about 200 g as measured according to the Wet Burst Test Method and a GM Modulus of less than 865 and/or less than 800 and/or less than 750 at 15 g/cm as measured according to the Modulus Test Method.

In another example of the present invention, a fibrous structure exhibits a Wet Burst of greater than 95 g to less than 355 and/or greater than 95 g to about 300 g and/or greater than 95 g to about 200 g as measured according to the Wet Burst Test Method and a GM Modulus of less than 1320 and/or less than 1250 and/or less than 1150 at 15 g/cm as measured according to the Modulus Test Method.

In yet another example of the present invention, a multi-ply fibrous structure exhibits a Wet Burst of greater than 30 g and/or from about 50 g to about 1000 g and/or from about 70 g to about 300 g as measured according to the Wet Burst Test Method and a GM Modulus of less than 865 and/or less than 800 and/or less than 750 at 15 g/cm as measured according to the Modulus Test Method.

In still another example of the present invention, a multi-ply fibrous structure exhibits a Wet Burst of greater than 95 g and/or greater than 95 g to about 1000 g and/or greater than 95 g to about 300 g as measured according to the Wet Burst Test Method and a GM Modulus of less than 1320 and/or less than 1250 and/or less than 1150 at 15 g/cm as measured according to the Modulus Test Method.

Figure 2:
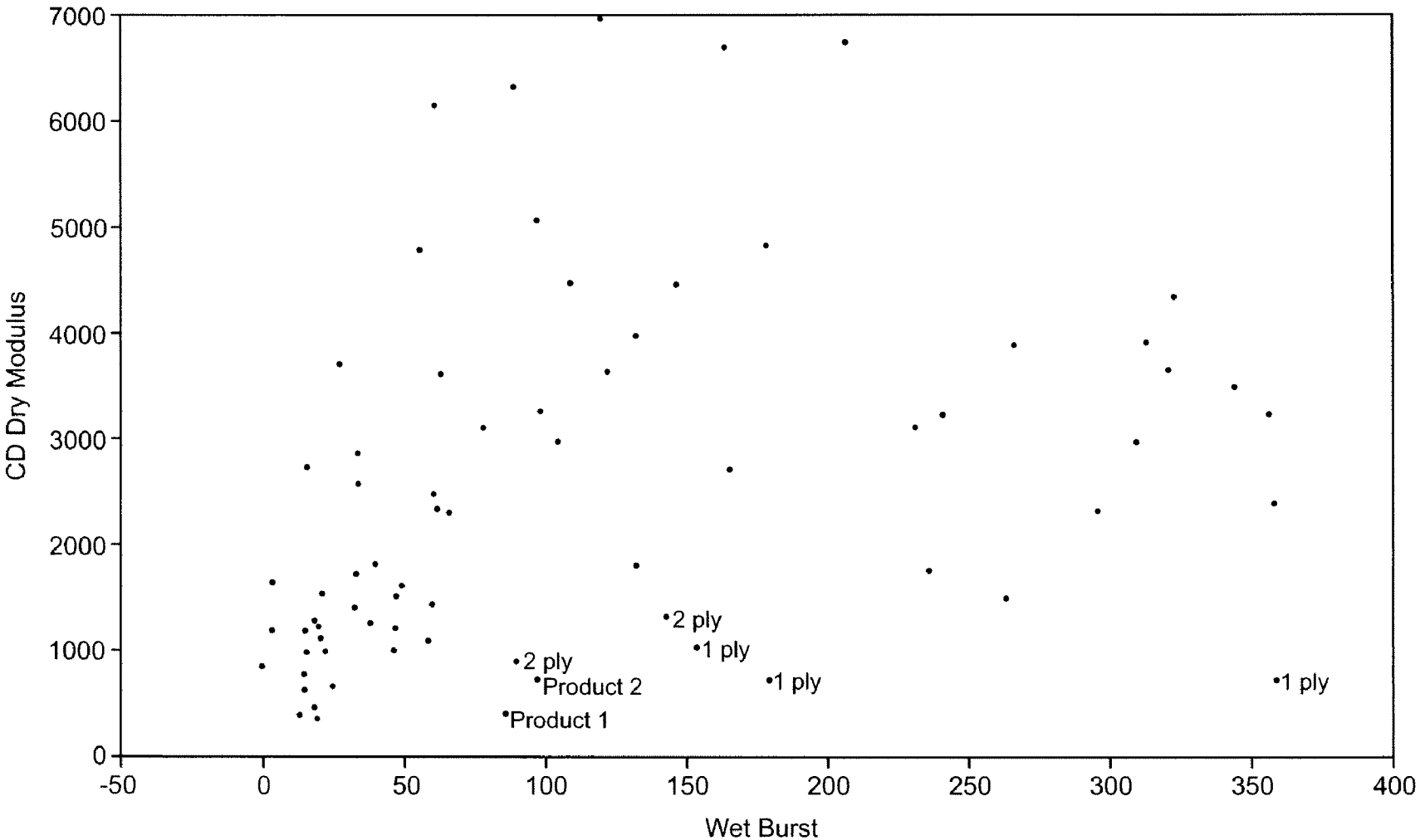
FIG. 2 is a plot of CD Modulus to Wet Burst for fibrous structures of the present invention and commercially available fibrous structures, both single-ply and multi-ply sanitary tissue products.

As shown in FIG. 2, a fibrous structure may exhibit a CD Modulus of less than 875 and/or less than 800 and/or less than 740 at 15 g/cm as measured according to the Modulus Test Method.

In another example of the present invention as shown in FIG. 2, a fibrous structure exhibits a CD Modulus of less than 710 and/or less than 500 and/or less than 425 at 15 g/cm as measured according to the Modulus Test Method.

In another example of the present invention as shown in FIG. 2, a multi-ply fibrous structure exhibits a CD Modulus of less than 1320 and/or less than 1000 and/or less than 750 at 15 g/cm as measured according to the Modulus Test Method.

In another example of the present invention as shown in FIG. 2, a fibrous structure exhibits a Wet Burst of greater than 30 g to less than 175 g and/or from about 50 g to about 125 g and/or from about 70 g to about 100 g as measured according to the Wet Burst Test Method. In another example of the present invention as shown in FIG. 2, a fibrous structure exhibits a Wet Burst of greater than 30 g and/or from about 50 g to about 1000 g and/or from about 70 g to about 300 g as measured according to the Wet Burst Test Method. In yet another example of the present invention as shown in FIG. 2, a multi-ply fibrous structure exhibits a Wet Burst of greater than 95 g and/or greater than 95 g to about 1000 g and/or greater than 95 g to about 300 g as measured according to the Wet Burst Test Method.

In one example of the present invention, a fibrous structure exhibits a Wet Burst of greater than 30 g and/or from about 50 g to about 1000 g and/or from about 70 g to about 300 g as measured according to the Wet Burst Test Method and a CD Modulus of less than 710 and/or less than 500 and/or less than 425 at 15 g/cm as measured according to the Modulus Test Method.

In another example of the present invention, a fibrous structure exhibits a Wet Burst of greater than 30 g to less than 175 g and/or from about 50 g to about 125 g and/or from about 70 g to about 100 g as measured according to the Wet Burst Test Method and a CD Modulus of less than 875 and/or less than 800 and/or less than 740 at 15 g/cm as measured according to the Modulus Test Method.

In yet another example of the present invention, a multi-ply fibrous structure exhibits a Wet Burst of greater than 95 g and/or greater than 95 g to about 1000 g and/or greater than 95 g to about 300 g as measured according to the Wet Burst Test Method and a CD Modulus of less than 1320 and/or less than 1000 and/or less than 750 at 15 g/cm as measured according to the Modulus Test Method.

In still another example of the present invention, a multi-ply fibrous structure exhibits a Wet Burst of greater than 30 g and/or from about 50 g to about 1000 g and/or from about 70 g to about 300 g as measured according to the Wet Burst Test Method and a CD Modulus of less than 875 and/or less than 800 and/or less than 740 at 15 g/cm as measured according to the Modulus Test Method.

One or more softening agents may be present on the fibrous structure in the form of a softening composition. Non-limiting examples of suitable softening agents include silicones, polysiloxanes, quaternary ammonium compounds, polyhydroxy compounds and mixtures thereof. The fibrous structures of the present invention may comprise a lotion composition.

Table 1 below shows the physical property values of fibrous structures in accordance with the present invention and commercially available fibrous structures.

TABLE 1

| | Plies | CD Dry Modulus | Geometric Modulus | Wet Burst |
|---|---|---|---|---|
| Product 1 | 2 | 395 | 735 | 86 |
| Product 2 | 2 | 722 | 1146 | 97 |
| Kleenex ® Basic New | 2 | 1206 | 963 | 47 |
| Kleenex ® Basic Old | 2 | 1501 | 1165 | 48 |
| Costco Kirkland ® | 2 | 1531 | 1185 | 21 |
| Kroger Nice N'Soft Ultra | 2 | 2558 | 1528 | 34 |
| Kroger Nice N'Soft Lotion | 3 | 2845 | 2051 | 34 |
| Safeway Softly Basic | 2 | 2717 | 1721 | 16 |
| Safeway Softly Ultra | 3 | 3697 | 2449 | 27 |
| Sam's Member's Mark | 2 | 1256 | 1242 | 38 |
| Target Basic | 2 | 1609 | 1282 | 49 |
| Target Lotion | 3 | 2321 | 1789 | 62 |
| Target Ultra | 3 | 1711 | 1489 | 33 |
| Walmart Basic | 2 | 1261 | 1233 | 19 |
| Walmart Lotion | 2 | 1221 | 1179 | 20 |
| Walmart Ultra | 3 | 1422 | 1555 | 60 |
| Viva ® | 1 | 720 | 635 | 360 |
| Scott ® | 1 | 1747 | 1944 | 237 |
| HEB | 2 | 2965 | 2334 | 310 |
| Brawny ® | 2 | 3230 | 2004 | 242 |
| Sparkle ® | 2 | 4818 | 3381 | 179 |
| Target SAS | 2 | 4340 | 2592 | 323 |
| Target | 2 | 3637 | 2234 | 322 |
| Sunrise | 2 | 6138 | 3512 | 61 |
| Nature Choice | 2 | 6689 | 6373 | 164 |
| Earth First | 2 | 2962 | 2796 | 105 |
| Scott Naturals ® | 1 | 6740 | 2799 | 208 |
| Mardis Gras ® | 2 | 6958 | 5152 | 120 |
| Krogers Everday | 2 | 3975 | 2781 | 132 |
| Krogers | 2 | 1083 | 1302 | 59 |
| Aldi's Clarissa | 2 | 3636 | 3567 | 122 |
| Aldi's Atlantic | 2 | 4785 | 3594 | 56 |
| Sparkle New Pkg | 2 | 4818 | 3381 | 179 |
| So-Dri | 2 | 4454 | 3216 | 147 |

TABLE 1-continued

| | Plies | CD Dry Modulus | Geometric Modulus | Wet Burst |
|---|---|---|---|---|
| Walgreen's Ultra | 2 | 3221 | 2140 | 357 |
| IGA Printed | 2 | 3249 | 3713 | 99 |
| Marcal | 2 | 6320 | 4585 | 89 |
| Family Dollar | 2 | 3096 | 3105 | 78 |
| Family Dollar Premium | 2 | 2707 | 2915 | 166 |
| Target Premium | 2 | 3108 | 2151 | 232 |
| Walgreen's TUF | 2 | 4460 | 3960 | 109 |
| Decorator | 2 | 5057 | 4047 | 97 |
| Meijer Premium | 2 | 3488 | 2661 | 345 |
| Costco Kirkland | 2 | 3880 | 2614 | 267 |
| Sam's Members Mark | 2 | 3899 | 2288 | 314 |
| Bounty ® Basic | 1 | 1495 | 1357 | 264 |
| Cottonelle ® Base 1 | 1 | 338 | 591 | 20 |
| Cottonelle ® Base 2 | 1 | 444 | 574 | 19 |
| Cottonelle ® Ultra 1 | 2 | 374 | 671 | 13 |
| Cottonelle ® Ultra 2 | 2 | 617 | 911 | 15 |
| Cottonelle ® Aloe and E | 1 | 651 | 785 | 25 |
| Angel Soft ® | 2 | 838 | 962 | 0 |
| Nice N Soft | 2 | 772 | 741 | 15 |
| Quilted Northern ® Base | 2 | 1172 | 953 | 15 |
| Quilted Northern ® Ultra | 2 | 963 | 742 | 16 |
| Scott ® 1000 | 1 | 1173 | 1118 | 4 |
| Scott ® Extra Soft | 1 | 1635 | 1400 | 4 |
| Charmin ® Basic 1 | 1 | 986 | 758 | 22 |
| Charmin ® Basic 2 | 1 | 1092 | 640 | 21 |
| Charmin ® Ultra | 2 | 994 | 972 | 47 |
| Charmin ® Ultra Strong | 2 | 1402 | 1213 | 33 |
| Bounty ® Extra Soft | 2 | 2313 | 2126 | 296 |
| Bounty ® | 2 | 2373 | 2417 | 359 |
| Puffs ® Basic | 2 | 882 | 872 | 90 |
| Scotties ® | 2 | 1808 | 1372 | 40 |
| Puffs ® Ultra | 2 | 1793 | 1492 | 133 |
| Kleenex ® Ultra | 3 | 2297 | 1632 | 66 |
| Scotties ® Ultra | 3 | 3603 | 2519 | 63 |
| Puffs ® Plus | 2 | 1325 | 1325 | 143 |
| Kleenex ® Lotion | 3 | 2471 | 2194 | 61 |
| Charmin ® Freshmates | 1 | 716 | 892 | 180 |
| Cottonelle ® Fresh | 1 | 1030 | 1233 | 154 |

In even yet another example of the present invention, a fibrous structure comprises cellulosic pulp fibers. However, other naturally-occurring and/or non-naturally occurring fibers and/or filaments may be present in the fibrous structures of the present invention.

In one example of the present invention, a fibrous structure comprises a through-air-dried fibrous structure. The fibrous structure may be creped or uncreped. In one example, the fibrous structure is a wet-laid fibrous structure.

The fibrous structure may be incorporated into a single- or multi-ply sanitary tissue product.

Figure 3:
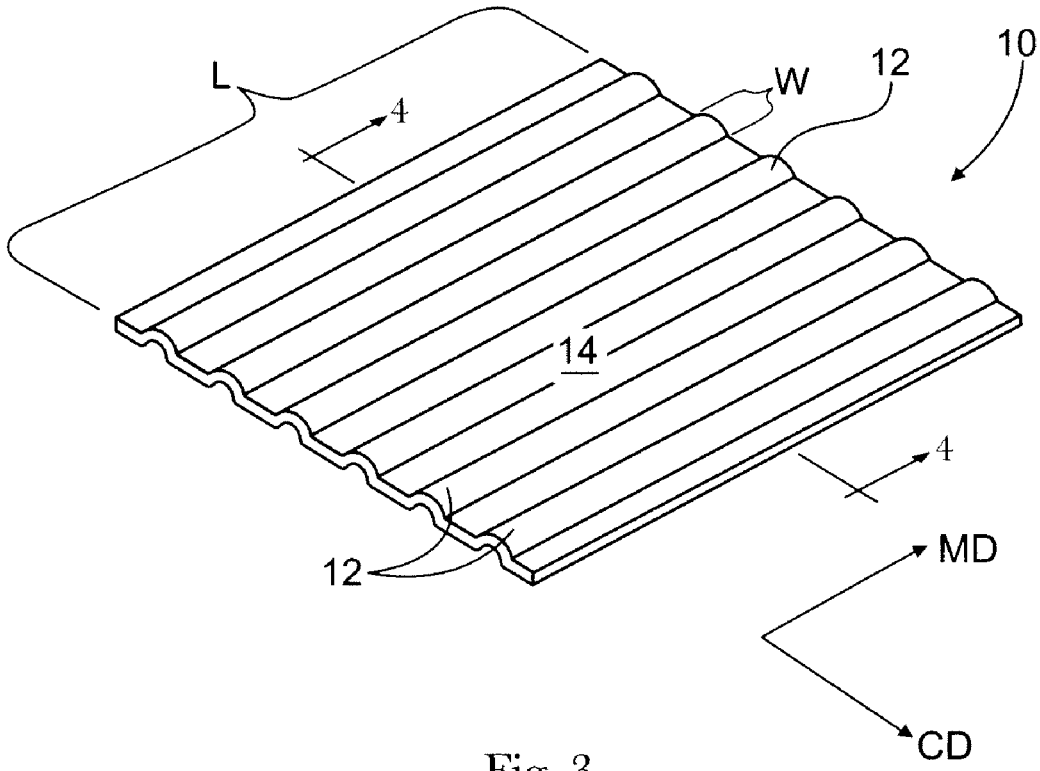
FIG. 3 is a schematic representation of an example of a fibrous structure in accordance with the present invention.
Figure 4:
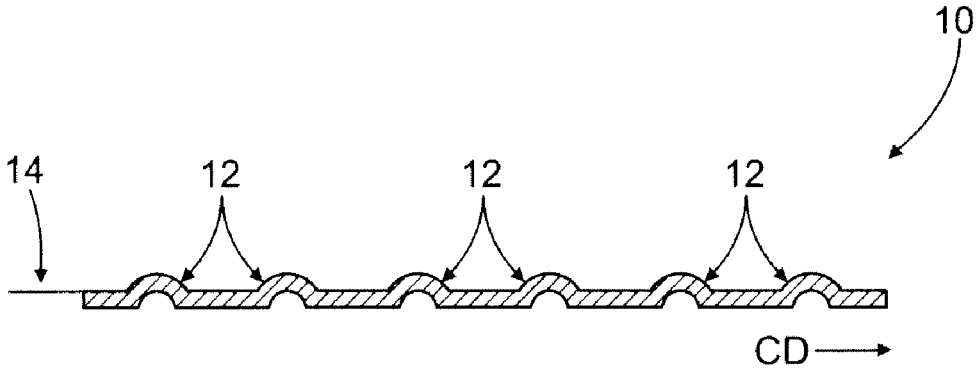
FIG. 4 is a cross-sectional view of FIG. 3 taken along line 4-4.
Figure 5:
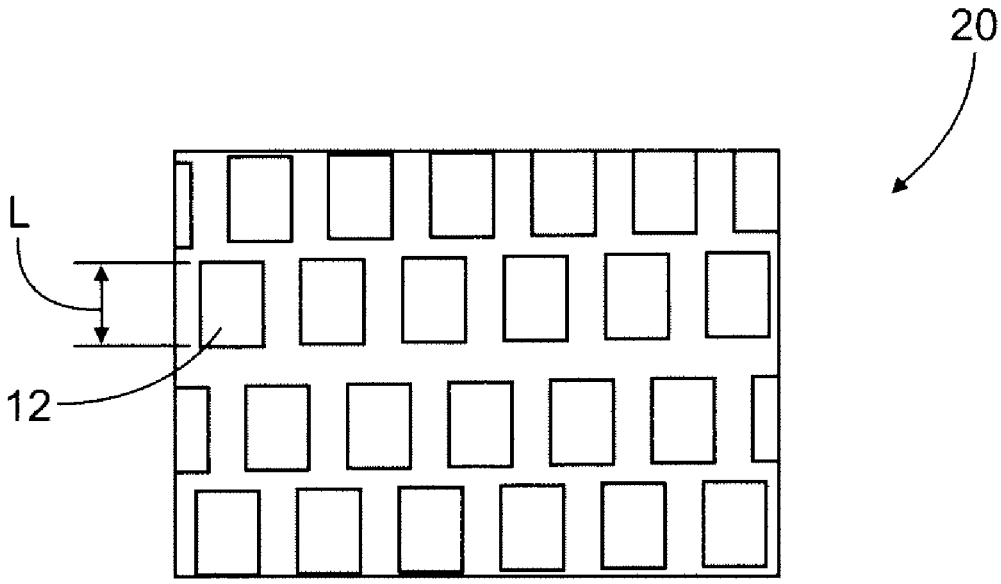
FIG. 5 is a schematic representation of a prior art fibrous structure comprising linear elements.
Figure 6:
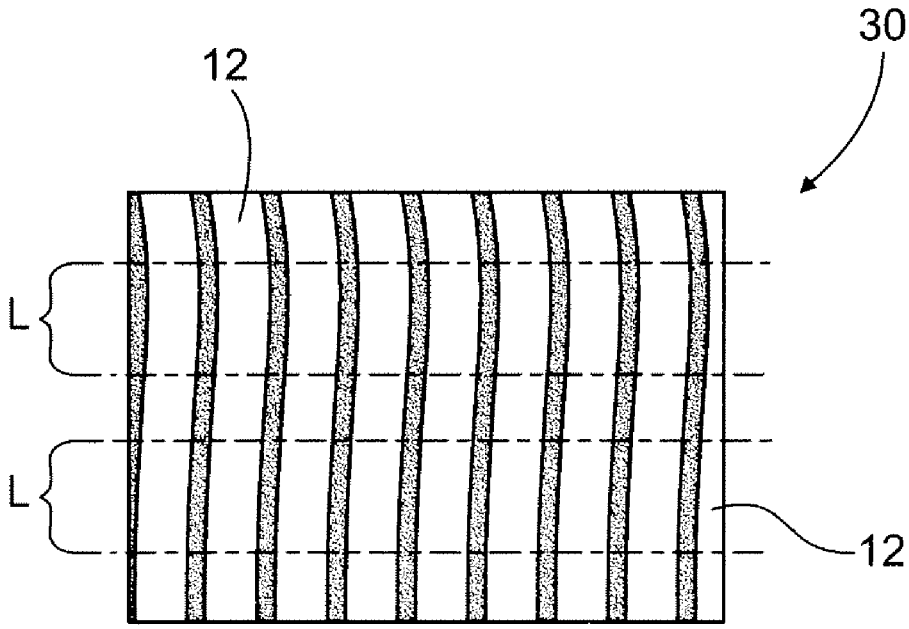
FIG. 6 is an electromicrograph of a portion of a prior art fibrous structure.

A nonlimiting example of a fibrous structure in accordance with the present invention is shown in FIGS. 3 and 4. FIGS. 3 and 4 show a fibrous structure 10 comprising one or more linear elements 12. The linear elements 12 are oriented in the machine or substantially the machine direction on the surface 14 of the fibrous structure 10. In one example, one or more of the linear elements 12 may exhibit a length L of greater than about 4.5 mm and/or greater than about 6 mm and/or greater than about 10 mm and/or greater than about 20 mm and/or greater than about 30 mm and/or greater than about 45 mm and/or greater than about 60 mm and/or greater than about 75 mm and/or greater than about 90 mm. For comparison, as shown in FIG. 5, a schematic representation of a commercially available toilet tissue product 20 has a plurality of substantially machine direction oriented linear elements 12 wherein the longest linear element 12 present in the toilet tissue product 20 exhibits a length L of 4.3 mm or less. FIG. 6 is a micrograph of a surface of a commercially available toilet tissue product 30 that comprises substantially machine direction oriented linear elements 12 wherein the longest linear element 12 present in the toilet tissue product 30 exhibits a length L of 4.3 mm or less.

In one example, the width W of one or more of the linear elements 12 is less than about 10 mm and/or less than about 7 mm and/or less than about 5 mm and/or less than about 2 mm and/or less than about 1.7 mm and/or less than about 1.5 mm to about 0 mm and/or to about 0.10 mm and/or to about 0.20 mm. In another example, the linear element height of one or more of the linear elements is greater than about 0.10 mm and/or greater than about 0.50 mm and/or greater than about 0.75 mm and/or greater than about 1 mm to about 4 mm and/or to about 3 mm and/or to about 2.5 mm and/or to about 2 mm.

In another example, the fibrous structure of the present invention exhibits a ratio of linear element height (in mm) to linear element width (in mm) of greater than about 0.35 and/or greater than about 0.45 and/or greater than about 0.5 and/or greater than about 0.75 and/or greater than about 1.

One or more of the linear elements may exhibit a geometric mean of linear element height by linear element of width of greater than about 0.25 mm2 and/or greater than about 0.35 mm2 and/or greater than about 0.5 mm2 and/or greater than about 0.75 mm2.

As shown in FIGS. 3 and 4, the fibrous structure 10 may comprise a plurality of substantially machine direction oriented linear elements 12 that are present on the fibrous structure 10 at a frequency of greater than about 1 linear element/5 cm and/or greater than about 4 linear elements/5 cm and/or greater than about 7 linear elements/5 cm and/or greater than about 15 linear elements/5 cm and/or greater than about 20 linear elements/5 cm and/or greater than about 25 linear elements/5 cm and/or greater than about 30 linear elements/5 cm up to about 50 linear elements/5 cm and/or to about 40 linear elements/5 cm.

In another example of a fibrous structure according to the present invention, the fibrous structure exhibits a ratio of a frequency of linear elements (per cm) to the width (in cm) of one linear element of greater than about 3 and/or greater than about 5 and/or greater than about 7.

The linear elements of the present invention may be in any shape, such as lines, zig-zag lines, serpentine lines. In one example, a linear element does not intersect another linear element.

Figure 7:
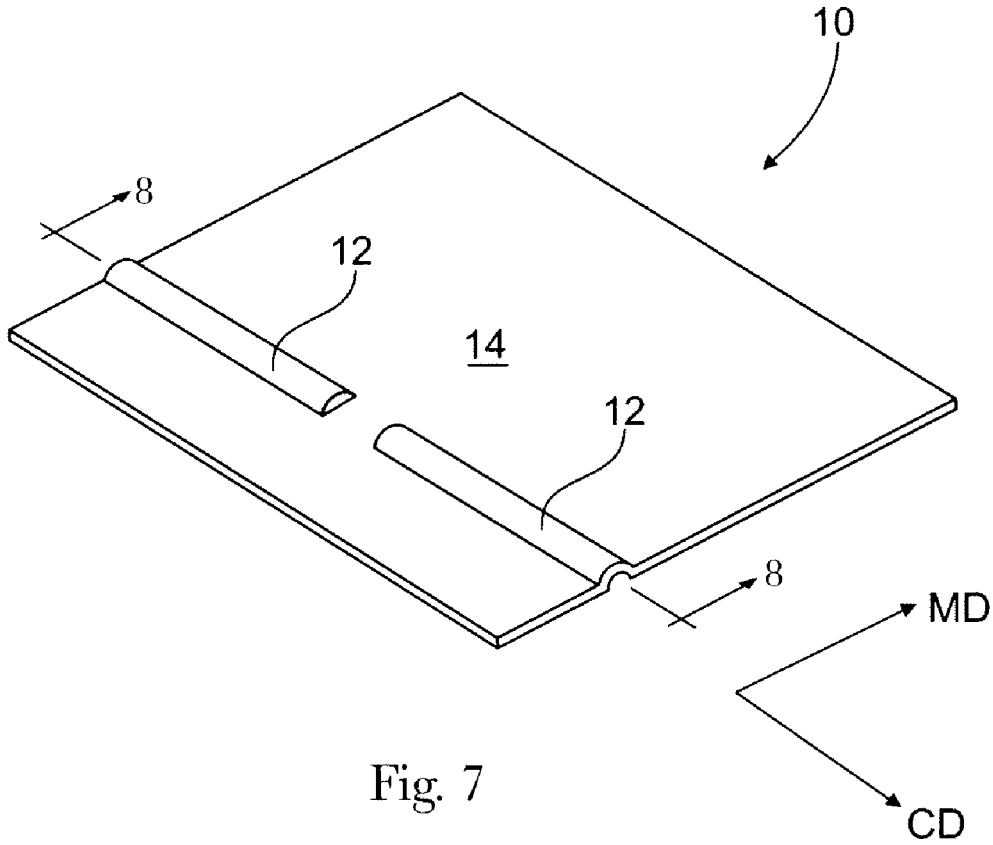
FIG. 7 is a schematic representation of an example of a fibrous structure according to the present invention.
Figure 8:
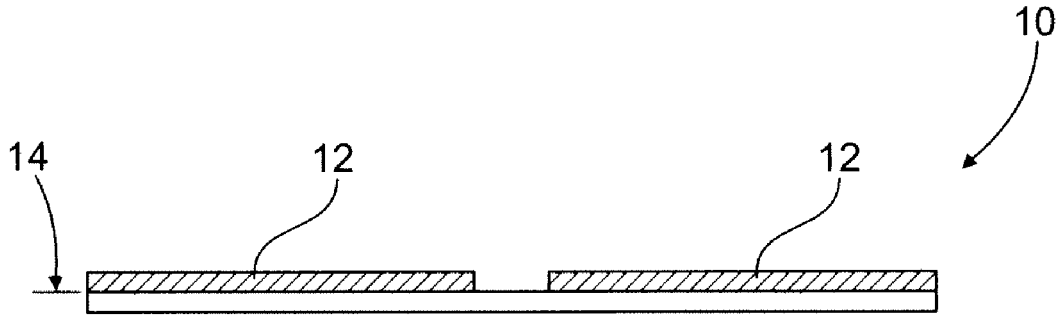
FIG. 8 is a cross-section view of FIG. 7 taken along line 8-8.

As shown in FIGS. 7 and 8, a fibrous structure 10 of the present invention may comprise one or more linear elements 12. The linear elements 12 may be oriented on a surface 14 of a fibrous structure 12 in any direction such as machine direction, cross machine direction, substantially machine direction oriented, substantially cross machine direction oriented. Two or more linear elements may be oriented in different directions on the same surface of a fibrous structure according to the present invention. In the case of FIGS. 7 and 8, the linear elements 12 are oriented in the cross machine direction. Even though the fibrous structure 10 comprises only two linear elements 12, it is within the scope of the present invention for the fibrous structure 10*a* to comprise three or more linear elements 12.

The dimensions (length, width and/or height) of the linear elements of the present invention may vary from linear element to linear element within a fibrous structure. As a result, the gap width between neighboring linear elements may vary from one gap to another within a fibrous structure.

In one example, the linear element may comprise an embossment. In another example, the linear element may be an embossed linear element rather than a linear element formed during a fibrous structure making process.

In another example, a plurality of linear elements may be present on a surface of a fibrous structure in a pattern such as in a corduroy pattern.

In still another example, a surface of a fibrous structure may comprise a discontinuous pattern of a plurality of linear elements wherein at least one of the linear elements exhibits a linear element length of greater than about 30 mm.

In yet another example, a surface of a fibrous structure comprises at least one linear element that exhibits a width of less than about 10 mm and/or less than about 7 mm and/or less than about 5 mm and/or less than about 3 mm and/or to about 0.01 mm and/or to about 0.1 mm and/or to about 0.5 mm.

The linear elements may exhibit any suitable height known to those of skill in the art. For example, a linear element may exhibit a height of greater than about 0.10 mm and/or greater than about 0.20 mm and/or greater than about 0.30 mm to about 3.60 mm and/or to about 2.75 mm and/or to about 1.50 mm. A linear element's height is measured irrespective of arrangement of a fibrous structure in a multi-ply fibrous structure, for example, the linear element's height may extend inward within the fibrous structure.

The fibrous structures of the present invention may comprise at least one linear element that exhibits a height to width ratio of greater than about 0.350 and/or greater than about 0.450 and/or greater than about 0.500 and/or greater than about 0.600 and/or to about 3 and/or to about 2 and/or to about 1.

In another example, a linear element on a surface of a fibrous structure may exhibit a geometric mean of height by width of greater than about 0.250 and/or greater than about 0.350 and/or greater than about 0.450 and/or to about 3 and/or to about 2 and/or to about 1.

The fibrous structures of the present invention may comprise linear elements in any suitable frequency. For example, a surface of a fibrous structure may comprises linear elements at a frequency of greater than about 1 linear element/5 cm and/or greater than about 1 linear element/3 cm and/or greater than about 1 linear element/cm and/or greater than about 3 linear elements/cm.

In one example, a fibrous structure comprises a plurality of linear elements that are present on a surface of the fibrous structure at a ratio of frequency of linear elements to width of at least one linear element of greater than about 3 and/or greater than about 5 and/or greater than about 7.

The fibrous structure of the present invention may comprise a surface comprising a plurality of linear elements such that the ratio of geometric mean of height by width of at least one linear element to frequency of linear elements is greater than about 0.050 and/or greater than about 0.750 and/or greater than about 0.900 and/or greater than about 1 and/or greater than about 2 and/or up to about 20 and/or up to about 15 and/or up to about 10.

Figure 9:
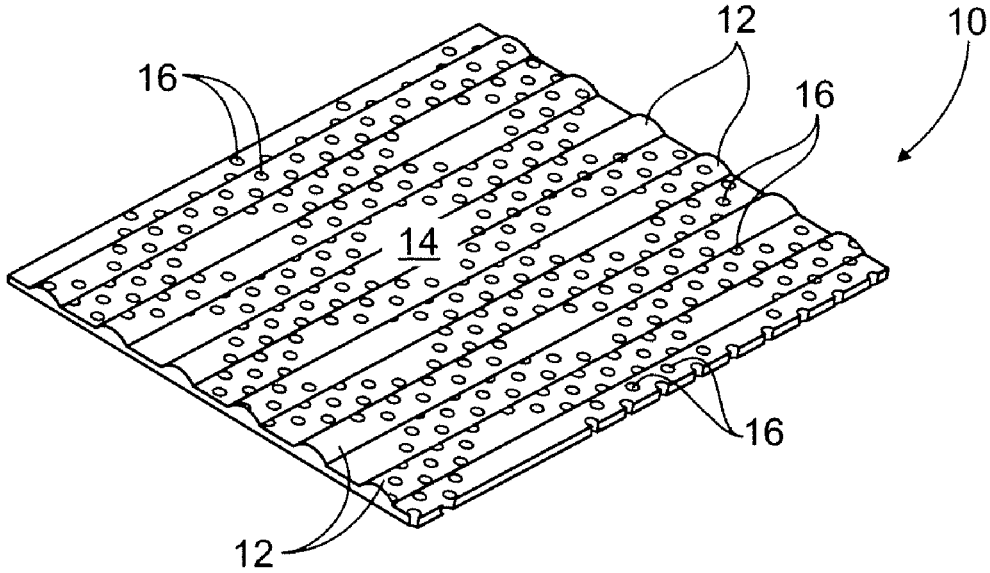
FIG. 9 is a schematic representation of an example of a fibrous structure according to the present invention.

In addition to one or more linear elements 12, as shown in FIG. 9, a fibrous structure 10 of the present invention may further comprise one or more non-linear elements 16. In one example, a non-linear element 16 present on the surface 14 of a fibrous structure 10 is water-resistant. In another example, a non-linear element 16 present on the surface 14 of a fibrous structure 10 comprises an embossment. When present on a surface of a fibrous structure, a plurality of non-linear elements may be present in a pattern. The pattern may comprise a geometric shape such as a polygon. Nonlimiting example of suitable polygons are selected from the group consisting of: triangles, diamonds, trapezoids, parallelograms, rhombuses, stars, pentagons, hexagons, octagons and mixtures thereof.

Figure 10:
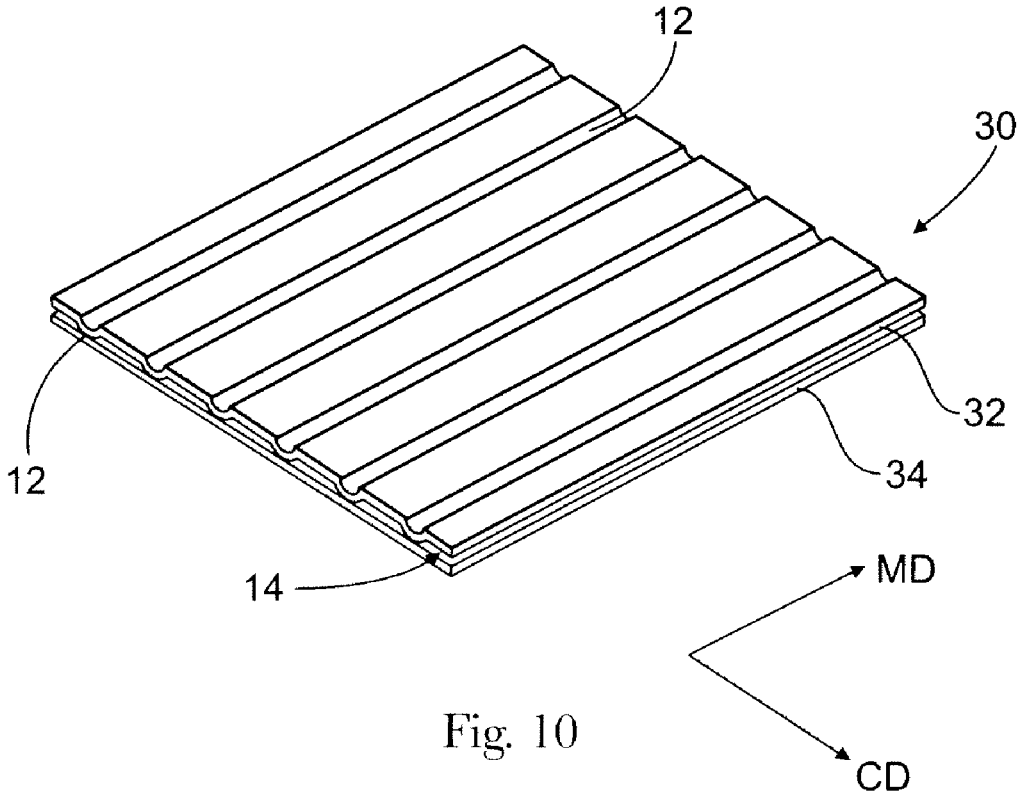
FIG. 10 is a schematic representation of an example of a fibrous structure according to the present invention.

One or more of the fibrous structures of the present invention may form a single- or multi-ply sanitary tissue product. In one example, as shown in FIG. 10, a multi-ply sanitary tissue product 30 comprises a first ply 32 and a second ply 34 wherein the first ply 32 comprises a surface 14 comprising a plurality of linear elements 12, in this case being oriented in the machine direction or substantially machine direction oriented. The plies 32 and 34 are arranged such that the linear elements 12 extend inward into the interior of the sanitary tissue product 30 rather than outward.

Figure 11:
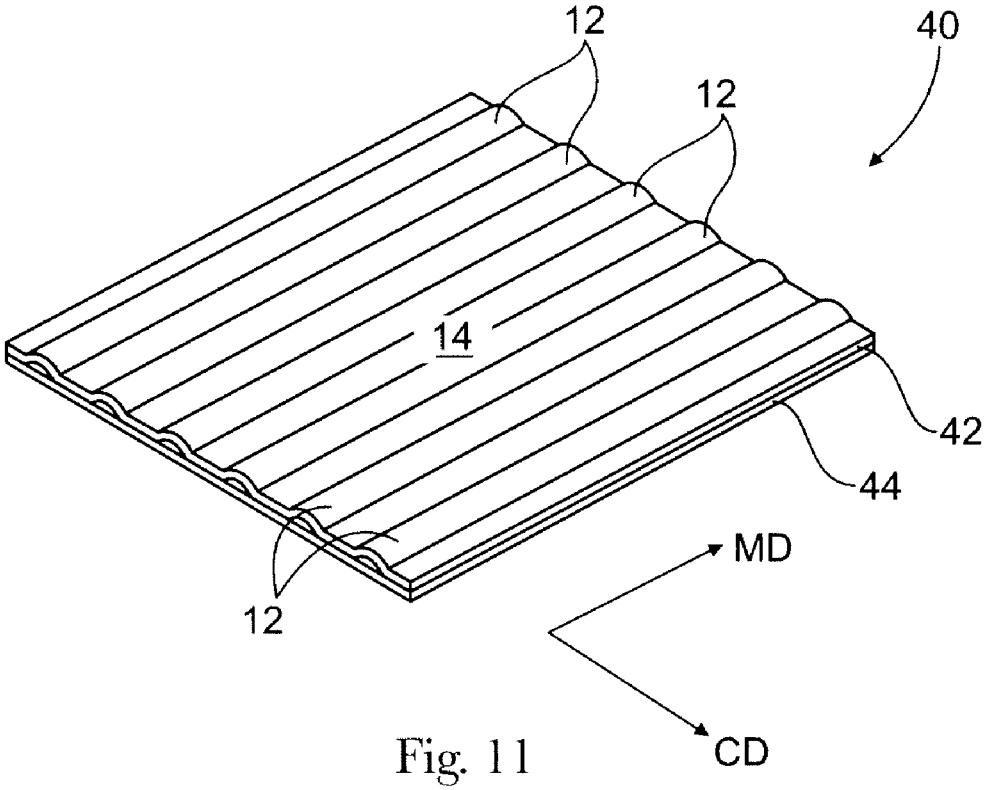
FIG. 11 is a schematic representation of an example of a fibrous structure according to the present invention.

In another example, as shown in FIG. 11, a multi-ply sanitary tissue product 40 comprises a first ply 42 and a second ply 44 wherein the first ply 42 comprises a surface 14 comprising a plurality of linear elements 12, in this case being oriented in the machine direction or substantially machine direction oriented. The plies 42 and 44 are arranged such that the linear elements 12 extend outward from the surface 14 of the sanitary tissue product 40 rather than inward into the interior of the sanitary tissue product 40.

Figure 12:
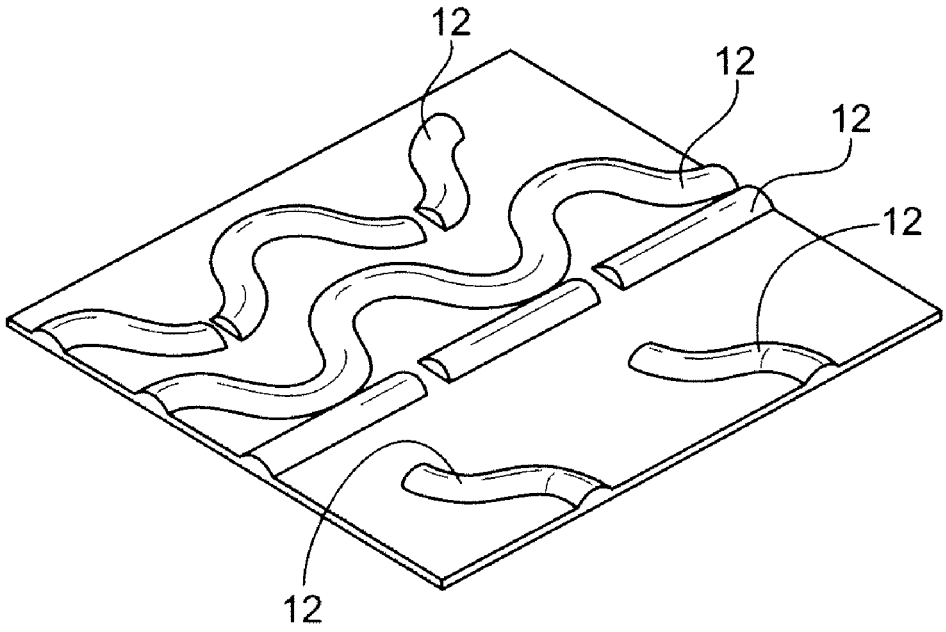
FIG. 12 is a schematic representation of an example of a fibrous structure comprising various forms of linear elements in accordance with the present invention.

As shown in FIG. 12, a fibrous structure 10 of the present invention may comprise a variety of different forms of linear elements 12, alone or in combination, such as serpentines, dashes, MD and/or CD oriented, and the like.

Non-Limiting Examples

Example 1

Product 1

An example of a fibrous structure in accordance with the present invention may be prepared using a fibrous structure making machine having a layered headbox having a top and bottom chamber.

A hardwood stock chest is prepared with eucalyptus fiber having a consistency of about 3.0% by weight. A softwood stock chest is prepared with NSK (northern softwood Kraft) and SSK (southern softwood Kraft) fibers having a consistency of about 3.0% by weight. The NSK and SSK fibers are refined to a Canadian Standard Freeness to about 570 milliliters (TAPPI Method™ 227 om-09) and are pumped to a blended stock chest with bleached broke fiber and machine broke fiber with a final consistency of about 2.5% by weight. A 2% solution of Kymene 1142, wet strength additive, is added to the NSK/SSK stock pipe prior to refining at about 18.0 lbs. per ton of dry fiber. Kymene 1142 is supplied by Hercules Corp of Wilmington, Del. The NSK/SSK slurry is mixed in a blended chest with machine broke and converting broke. A 1% solution of carboxy methyl cellulose (CMC) is added to the NSK/SSK blended slurry at a rate of about 6.4 lbs. per ton of dry fiber to enhance the dry strength of the fibrous structure. CMC is supplied by CP Kelco. The aqueous slurry of NSK fibers passes through a centrifugal stock pump to aid in distributing the CMC.

The NSK blended slurry is diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are directed to a multi-channeled headbox suitably equipped with layering leaves to maintain the streams as separate layers until discharged onto a traveling Fourdrinier wire. A two layered headbox is used. The eucalyptus slurry containing 45% of the dry weight of the tissue ply is directed to the chamber leading to the layer in contact with the wire, while the NSK slurry comprising 55% of the dry weight of the ultimate tissue ply is directed to the chamber leading to the outside layer. The NSK and eucalyptus slurries are combined at the discharge of the headbox into a composite slurry.

The composite slurry is discharged onto the traveling Fourdrinier wire and is dewatered assisted by a deflector and vacuum boxes. The Fourdrinier wire is an AJ123a (866a) having 205 machine-direction and 150 cross-machine-direction monofilaments per inch. The speed of the Fourdrinier wire is about 3150 fpm (feet per minute).

The embryonic wet web is dewatered to a consistency of about 15% just prior to transfer to a patterned drying fabric made in accordance with U.S. Pat. No. 4,529,480. The speed of the patterned drying fabric is about 1.3% faster than the speed of the Fourdrinier wire. The drying fabric is designed to yield a pattern of substantially machine direction oriented linear channels having a continuous network of high density (knuckle) areas. This drying fabric is formed by casting an impervious resin surface onto a fiber mesh supporting fabric. The supporting fabric is a 127×52 filament, dual layer mesh. The thickness of the resin cast is about 9 mils above the supporting fabric. The area of the continuous network is about 40 percent of the surface area of the drying fabric.

Further de-watering is accomplished by vacuum assisted drainage until the web has a fiber consistency of about 25%. While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed creping adhesive coating. The coating is a blend consisting of National Starch and Chemical's Redibond 5330 and Vinylon Works' Vinylon 99-60. The fiber consistency is increased to about 97% before the web is dry creped from the Yankee with a doctor blade.

The doctor blade has a bevel angle of about 23 degrees and is positioned with respect to the Yankee dryer to provide an impact angle of about 85 degrees. The Yankee dryer is operated at a temperature of about 280° F. (177° C.) and a speed of about 3200 fpm. The fibrous structure is wound in a roll using a surface driven reel drum having a surface speed of about 2621 feet per minute.

Two plies are combined with the wire side facing out. During the converting process, a surface softening agent may be applied with a slot extrusion die to the outside surface of both plies. The surface softening agent is a 19% solution of silicone (i.e. MR-1003, marketed by Wacker Chemical Corporation of Adrian, Mich.). The solution is applied to the web at a rate of about 1250 ppm. The plies are then bonded together with mechanical plybonding wheels, slit, and then folded into finished 2-ply facial tissue product. Each ply and the combined plies are tested in accordance with the test methods described supra.

Example 2

Product 2

An example of a fibrous structure in accordance with the present invention may be prepared using a fibrous structure making machine having a layered headbox having a top and bottom chamber.

A hardwood stock chest is prepared with eucalyptus fiber having a consistency of about 3.0% by weight. A softwood stock chest is prepared with NSK (northern softwood Kraft) and SSK (southern softwood Kraft) fibers having a consistency of about 3.0% by weight. The NSK and SSK fibers are refined to a Canadian Standard Freeness to about 570 milliliters (TAPPI Method™ 227 om-09) and are pumped to a blended stock chest with bleached broke fiber and machine broke fiber with a final consistency of about 2.5% by weight. A 2% solution of Kymene 1142, wet strength additive, is added to the NSK/SSK stock pipe prior to refining at about 19.0 lbs. per ton of dry fiber. Kymene 1142 is supplied by Hercules Corp of Wilmington, Del. The NSK/SSK slurry is mixed in a blended chest with machine broke and converting broke. A 1% solution of carboxy methyl cellulose (CMC) is added to the NSK/SSK blended slurry at a rate of about 4.5 lbs. per ton of dry fiber to enhance the dry strength of the fibrous structure. CMC is supplied by CP Kelco. The aqueous slurry of NSK fibers passes through a centrifugal stock pump to aid in distributing the CMC.

The NSK blended slurry is diluted with white water at the inlet of a fan pump to a consistency of about 0.15% based on the total weight of the NSK fiber slurry. The eucalyptus fibers, likewise, are diluted with white water at the inlet of a fan pump to a consistency of about 0.15% based on the total weight of the eucalyptus fiber slurry. The eucalyptus slurry and the NSK slurry are directed to a multi-channeled headbox suitably equipped with layering leaves to maintain the streams as separate layers until discharged onto a traveling Fourdrinier wire. A two layered headbox is used. The eucalyptus slurry containing 54% of the dry weight of the tissue ply is directed to the chamber leading to the layer in contact with the wire, while the NSK slurry comprising 46% of the dry weight of the ultimate tissue ply is directed to the chamber leading to the outside layer. The NSK and eucalyptus slurries are combined at the discharge of the headbox into a composite slurry.

The composite slurry is discharged onto the traveling Fourdrinier wire and is dewatered assisted by a deflector and vacuum boxes. The Fourdrinier wire is an AJ123a (866a) having 205 machine-direction and 150 cross-machine-direction monofilaments per inch. The speed of the Fourdrinier wire is about 2750 fpm (feet per minute).

The embryonic wet web is dewatered to a consistency of about 15% just prior to transfer to a patterned drying fabric made in accordance with U.S. Pat. No. 4,529,480. The speed of the patterned drying fabric is about 1.3% faster than the speed of the Fourdrinier wire. The drying fabric is designed to yield a pattern of substantially machine direction oriented linear channels having a continuous network of high density (knuckle) areas. This drying fabric is formed by casting an impervious resin surface onto a fiber mesh supporting fabric. The supporting fabric is a 127×52 filament, dual layer mesh. The thickness of the resin cast is about 9 mils above the supporting fabric. The area of the continuous network is about 40 percent of the surface area of the drying fabric.

Further de-watering is accomplished by vacuum assisted drainage until the web has a fiber consistency of about 25%. While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed a creping adhesive coating. The coating is a blend consisting of National Starch and Chemical's Redibond 5330 and Vinylon Works' Vinylon 99-60. The fiber consistency is increased to about 97% before the web is dry creped from the Yankee with a doctor blade.

The doctor blade has a bevel angle of about 23 degrees and is positioned with respect to the Yankee dryer to provide an impact angle of about 85 degrees. The Yankee dryer is operated at a temperature of about 280° F. and a speed of about 2800 fpm. The fibrous structure is wound in a roll using a surface driven reel drum having a surface speed of about 2379 feet per minute.

Two plies are combined with the wire side facing out. During the converting process, a surface softening agent is applied with a slot extrusion die to the outside surface of both plies. The surface softening agent is a formula containing one or more polyhydroxy compounds (Polyethylene glycol, Polypropylene glycol, and/or copolymers of the like marketed by BASF Corporation of Florham Park, N.J.), glycerin (marketed by PG Chemical Company), and silicone. The solution is applied to the web at a rate of about 5.45% by weight. The plies are then bonded together with mechanical plybonding wheels, slit, and then folded into finished 2-ply facial tissue product. Each ply and the combined plies are tested in accordance with the test methods described supra.

Test Methods

Unless otherwise specified, all tests described herein including those described under the Definitions section and the following test methods are conducted on samples that have been conditioned in a conditioned room at a temperature of 73° F.±4° F. (about 23° C.±2.2° C.) and a relative humidity of 50%±10% for 2 hours prior to the test. All plastic and paper board packaging materials must be carefully removed from the paper samples prior to testing. Discard any damaged product. All tests are conducted in such conditioned room.

Basis Weight Test Method

Basis weight of a fibrous structure sample is measured by selecting twelve (12) usable units (also referred to as sheets) of the fibrous structure and making two stacks of six (6) usable units each. Performation must be aligned on the same side when stacking the usable units. A precision cutter is used to cut each stack into exactly 8.89 cm×8.89 cm (3.5 in.×3.5 in.) squares. The two stacks of cut squares are combined to make a basis weight pad of twelve (12) squares thick. The basis weight pad is then weighed on a top loading balance with a minimum resolution of 0.01 g. The top loading balance must be protected from air drafts and other disturbances using a draft shield. Weights are recorded when the readings on the top loading balance become constant. The Basis Weight is calculated as follows:

$$\text{Basis Weight (lbs/3000 ft}^2) = \frac{\text{Weight of basis weight pad (g)} \times 3000\ \text{ft}^2}{453.6\ \text{g/lbs} \times 12(\text{usable units}) \times [12.25\ \text{in}^2(\text{Area of basis weight pad})/144\ \text{in}^2]}$$

$$\text{Basis Weight (g/m}^2) = \frac{\text{Weight of basis weight pad (g)} \times 10{,}000\ \text{cm}^2/\text{m}^2}{79.0321\ \text{cm}^2(\text{Area of basis weight pad}) \times 12(\text{usable units})}$$

Caliper Test Method

Caliper of a fibrous structure is measured by cutting five (5) samples of fibrous structure such that each cut sample is larger in size than a load foot loading surface of a VIR Electronic Thickness Tester Model II available from Thwing-Albert Instrument Company, Philadelphia, Pa. Typically, the load foot loading surface has a circular surface area of about 3.14 in2. The sample is confined between a horizontal flat surface and the load foot loading surface. The load foot loading surface applies a confining pressure to the sample of 15.5 g/cm2. The caliper of each sample is the resulting gap between the flat surface and the load foot loading surface. The caliper is calculated as the average caliper of the five samples. The result is reported in millimeters (mm).

Modulus Test Method

Remove five (5) strips of four (4) usable units (also referred to as sheets) of fibrous structures and stack one on top of the other to form a long stack with the perforations between the sheets coincident. Identify sheets 1 and 3 for machine direction tensile measurements and sheets 2 and 4 for cross direction tensile measurements. Next, cut through the perforation line using a paper cutter (JDC-1-10 or JDC-1-12 with safety shield from Thwing-Albert Instrument Co. of Philadelphia, Pa.) to make 4 separate stacks. Make sure stacks 1 and 3 are still identified for machine direction testing and stacks 2 and 4 are identified for cross direction testing.

Cut two 2.54 cm wide strips in the machine direction from stacks 1 and 3. Cut two 2.54 cm wide strips in the cross direction from stacks 2 and 4. There are now four 2.54 cm wide strips for machine direction tensile testing and four 2.54 cm wide strips for cross direction tensile testing. For these finished product samples, all eight 2.54 cm wide strips are five usable units (sheets) thick.

For the actual measurement of the elongation, tensile strength, TEA and modulus, use a Thwing-Albert Intelect II Standard Tensile Tester (Thwing-Albert Instrument Co. of Philadelphia, Pa.). Insert the flat face clamps into the unit and calibrate the tester according to the instructions given in the operation manual of the Thwing-Albert Intelect II. Set the instrument crosshead speed to 10.16 cm/min and the 1st and 2nd gauge lengths to 5.08 cm. The break sensitivity is set to 20.0 grams and the sample width is set to 2.54 cm and the sample thickness is set to 1 cm. The energy units are set to TEA and the tangent modulus (Modulus) trap setting is set to 38.1 g.

Take one of the fibrous structure sample strips and place one end of it in one clamp of the tensile tester. Place the other end of the fibrous structure sample strip in the other clamp. Make sure the long dimension of the fibrous structure sample strip is running parallel to the sides of the tensile tester. Also make sure the fibrous structure sample strips are not overhanging to the either side of the two clamps. In addition, the pressure of each of the clamps must be in full contact with the fibrous structure sample strip.

After inserting the fibrous structure sample strip into the two clamps, the instrument tension can be monitored. If it shows a value of 5 grams or more, the fibrous structure sample strip is too taut. Conversely, if a period of 2-3 seconds passes after starting the test before any value is recorded, the fibrous structure sample strip is too slack.

Start the tensile tester as described in the tensile tester instrument manual. The test is complete after the crosshead automatically returns to its initial starting position. When the test is complete, read and record the following with units of measure:

Tangent Modulus (Modulus) (at 15 g/cm)

Test each of the samples in the same manner, recording the above measured values from each test.

Calculations:

Modulus=MD Modulus (at 15 g/cm)+CD Modulus (at 15 g/cm)

Geometric Mean (GM) Modulus=Square Root of [MD Modulus (at 15 g/cm)×CD Modulus (at 15 g/cm)]

Dimensions of Linear Element/Linear Element Forming Component Test Method

The length of a linear element in a fibrous structure and/or the length of a linear element forming component in a molding member is measured by image scaling of a light microscopy image of a sample of fibrous structure.

A light microscopy image of a sample to be analyzed such as a fibrous structure or a molding member is obtained with a representative scale associated with the image. The images is saved as a *.tiff file on a computer. Once the image is saved, SmartSketch, version 05.00.35.14 software made by Intergraph Corporation of Huntsville, Ala., is opened. Once the software is opened and running on the computer, the user clicks on "New" from the "File" drop-down panel. Next, "Normal" is selected. "Properties" is then selected from the "File" drop-down panel. Under the "Units" tab, "mm" (millimeters) is chosen as the unit of measure and "0.123" as the precision of the measurement. Next, "Dimension" is selected from the "Format" drop-down panel. Click the "Units" tab and ensure that the "Units" and "Unit Labels" read "mm" and that the "Round-Off" is set at "0.123." Next, the "rectangle" shape from the selection panel is selected and dragged into the sheet area. Highlight the top horizontal line of the rectangle and set the length to the corresponding scale indicated light microscopy image. This will set the width of the rectangle to the scale required for sizing the light microscopy image. Now that the rectangle has been sized for the light microscopy image, highlight the top horizontal line and delete the line. Highlight the left and right vertical lines and the bottom horizontal line and select "Group". This keeps each of the line segments grouped at the width dimension ("mm") selected earlier. With the group highlighted, drop the "line width" panel down and type in "0.01 mm." The scaled line segment group is now ready to use for scaling the light microscopy image can be confirmed by right-clicking on the "dimension between", then clicking on the two vertical line segments.

To insert the light microscopy image, click on the "Image" from the "insert" drop-down panel. The image type is preferably a *.tiff format. Select the light microscopy image to be inserted from the saved file, then click on the sheet to place the light microscopy image. Click on the right bottom corner of the image and drag the corner diagonally from bottom-right to top-left. This will ensure that the image's aspect ratio will not be modified. Using the "Zoom In" feature, click on the image until the light microscopy image scale and the scale group line segments can be seen. Move the scale group segment over the light microscopy image scale. Increase or decrease the light microscopy image size as needed until the light microscopy image scale and the scale group line segments are equal. Once the light microscopy image scale and the scale group line segments are visible, the object(s) depicted in the light microscopy image can be measured using "line symbols" (located in the selection panel on the right) positioned in a parallel fashion and the "Distance Between" feature. For length and width measurements, a top view of a fibrous structure and/or molding member is used as the light microscopy image. For a height measurement, a side or cross sectional view of the fibrous structure and/or molding member is used as the light microscopy image.

Wet Burst Test Method

The wet burst strength of fibrous structures and sanitary tissue products comprising fibrous structures (collectively referred to as "sample" or "samples" within this test method) is determined using an electronic burst tester and specified test conditions. The results obtained are averaged and the wet burst strength is reported. Provisions are made for testing rapid-aged samples as well as fresh or naturally aged samples.

Apparatus: Burst Tester—Refer to manufacturer's operation and set-up instructions.

Note: Thwing-Albert Wet Burst Testers with an upward force measurement yields values approximately 3-7 grams higher than testers with a downward force measurement. This is due to the weight of the wetted product resting on the load cell. Therefore, the downward movement is preferred and when comparing data, the instrument used should be noted.

Calibration Weights—Refer to manufacturer's Calibration instructions

Paper Cutter—Cutting board, 24 in. (600 mm) size

Scissors—4 in. (100 mm), or larger

Pan—Approximate Width/Length/Depth: 9 in.×12 in.×2 in. (240×300×50 mm), or equivalent Oven Forced draft, 221° F.±2° F. (105° C.±1° C.) with wire shelves. Blue M or equivalent Clamp (For use in rapid aging samples) Day Pinchcock, Fisher Cat. No. 05-867, or equivalent Re-sealable plastic bags—Size 26.8 cm×27.9 cm Distilled water at the temperature of the conditioned room used Sample Preparation For this method, a usable unit is described as one sanitary tissue product unit regardless of the number of plies.

Sample Preparation 1-ply and 2-ply Towels: For towels having a sheet length (MD) of approximately 11 in. (280 mm), remove two sample sheets from the roll. Separate the sample sheets at the perforations and stack them on top of each other. Cut the sample sheets in half in the Machine Direction to make a sample stack of four sample sheets thick. For sample sheets smaller than 11 in. (280 mm), remove two strips of three sample sheets from the roll. Stack the strips so that the perforations and edges are coincident. Remove equal portions of each of the end sample sheets by cutting in the cross direction so that the total length of the center sample sheets plus the remaining portions of the two end sample sheets is approximately 11 inches (280 mm). Cut the sample stack in half in the machine direction to make a sample stack four sample sheets thick.

Paper Napkins (Folded, Cut & Stacked): For napkins select 4 sample sheets from the sample stack. For all napkins, either 1-ply or 2-ply and either double or triple folded, unfold the sample sheets until it is a large rectangle with only one fold remaining in the MD direction. One-ply napkins will have 2 loose 1-ply layers, 2-ply napkins will have 2 loose 2-ply layers. Stack the sample sheets so that the MD folded edges are aligned and the opened, CD folds are on top of each other. To prevent the wet burst test from occurring right on the opened CD fold in the center of each sample sheet, cut one end off of the stack so that the sample sheets are at least 10 inches (254 mm) in the MD direction and the fold is shifted off-center.

Facial C-Fold Reach-in: Remove 8 sample sheets and stack them in pairs of two. Using scissors, cut the (C) fold off in the Machine Direction. You now have 4 stacks 9 in. (230 mm) machine direction by 4.5 in. (115 mm) cross direction, each two sample sheets thick.

Facial-V-Fold Pop-up: Remove 8 sample sheets and stack them in pairs of two. Using scissors, cut the stacks 4.5 in. (115 mm) from the bonded edge so you have 9 in. (230 mm) machine direction by 4.5 in. (115 mm) cross direction samples, each two sample sheets thick.

1-Ply Toilet Tissue: If beginning a new tissue roll the first 15 sample sheets have to be removed (to remove Tail-Release-Gluing). Roll off 16 strips of product each 3 sample sheets in length. It is important that the center sample sheet in each three sample sheet strips not be stretched or wrinkled since it is the unit to be tested. Ensure that sheet perforations are not in the area to be tested. Stack the 3 sample sheet strips 4 high, 4 times to form your test samples.

2-Ply/3-Ply/4-Ply Toilet Tissue: If beginning a new tissue roll, the first 15 sample sheets have to be removed (to remove Tail-Release-Gluing). Roll off 8 strips of product each, 3 sample sheets in length. It is important the center sample sheet in each three sample sheet strip not be stretched or wrinkled since it is the sample sheet to be tested. Ensure that sheet perforations are not in the area to be tested. Stack the 3 sample sheet strips 2 high, 4 times to form your test samples.

Stacked Wipes: Remove 4 sample sheets from the sample container and seal remaining product in plastic bag. Test immediately.

Fresh or Naturally Aged Samples: Test prepared samples as described under Operation. Results on freshly produced paper and the same paper after aging for some period of time will frequently differ.

Rapid Aging: Rapid aging of samples results in answers which are more indicative of sample performance after aging in a warehouse, during shipping, or in the marketplace. When required, rapid age samples by one of the following methods, selecting the method that is sufficient to fully age the product, this can be established via sample aging profiles.

5 Minute Rapid Aging: Attach a small paper clip or clamp at the center of one of the narrow edges (perforated edge for sample; 6 in. (152.4 mm) for unconverted stock) of each sample stack: four sample sheets thick for towels, facials eight sample sheets thick, 1-ply toilet tissue 16 sheets thick, 2-ply/3-ply/4-ply toilet tissue and hankies eight sheets thick, a sample stack for reel samples is eight plies thick. Suspend each sample stack by a clamp in a 221° F.±2° F. (105° C.±1° C.) forced draft oven for a period of five minutes±10 seconds at temperature. Remove the sample stack from the oven and cool for a minimum of 3 minutes before testing. Test the sample portions as described under Operation.

Operation

Set-up and calibrate the Burst tester instrument according to the manufacturer's instructions for the instrument being used. Verify that the Burst tester program settings match those summarized in Table 3. Remove one sample portion from the sample stack holding the sample by the narrow edges, dipping the center of the sample into a pan filled approximately 1 in. (25 mm) from the top with distilled water. Leave the sample in the water for 4 (±0.5) seconds. Remove and drain excess water from the sample for 3 (±0.5) seconds holding the sample in a vertical position. Drainage allows removal of excess water for protection of the burst tester electronics. Proceed with the test immediately after the drain step. Ensure the sample has no perforations in the area of the sample to be tested. Place the sample between the upper and lower rings. Center the wet sample flatly on the lower ring of the sample holding device. Lower the upper ring of the pneumatic holding device to secure the sample. Start the test. The test is over at sample failure (rupture). Record the maximum value. The plunger will automatically reverse and return to its original starting position. Raise the upper ring, remove and discard the tested sample. Repeat this procedure until all samples have been tested.

Calculations

Since some burst testers incorporate computer capabilities that support calculations, it may not be necessary to apply the following calculations to the test results. For example, the Thwing-Albert EJA and Intelect II STD Burst Tester can be operated through its menu and Program Settings options to support the calculations required for reporting wet burst results (see Tables 2 and 3). If these capabilities are not available, then calculate the appropriate average wet burst results as described below. The results are reported on the basis of a single sanitary tissue product sheet.

Wet Burst=sum of peak load readings/number of replicates tested

Deflection=sum of peak deflection readings/number of replicates tested

Burst Energy Absorption* to peak load (BEA)=sum of peak BEA readings/number of reps tested

*Burst Energy Absorption is the area of the stress/strain curve between pre-tension and peak load Reporting Results Report the Wet Burst results to the nearest gram Report the Deflection results to the nearest 0.1 inch Report the BEA results to the nearest 0.1 g*in/in$^2$

TABLE 2

Total number of usable units (sample sheets) tested

| Sample Description Finished Product | Total # of usable units | Load divider |
|---|---|---|
| Towels | 4 | 1 |
| Facial | 8 | 2 |
| Napkins | 4 | 1 |
| Hankies | 8 | 2 |
| 1-Ply Toilet Tissue | 16 | 4 |
| 2-Ply/3-Ply/4-Ply Toilet Tissue | 8 | 2 |
| Handsheets | 4 | 1 |
| Wipes | 4 | 1 |

TABLE 3

Burst Tester Settings for a 2000 gram load cell

Burst Tester Settings for a 2000 gram load cell

| | | Intelect II STD Burst Tester |
|---|---|---|
| Set Mode | Manual | x |
| English/Metric | English | x |
| Curve Units | Load/deflection | x |
| Compression Units | Inches | |
| Load Units | Grams | x |
| Energy Units | BEA | x |
| Test over | Fail | x |
| Set Range | 100% | x |
| At Test End | Return | x |
| Pre-Test Speed | 5.00 inches/minute | |
| Test Speed | 5.00 inches/minute | x |
| Start of Test Speed | 5.00 inches/minute | |
| Start of Test distance | 0.100 inches | |
| Post-change-speed | 5.00 inches/minute | |
| Return Speed | 20 or 40 inches/minute | x |
| Sampling Rate | 20 reading/second | x |
| Gauge length | 0.025 inches | |
| Adj. Gauge length | Adjusted | |
| Sample Thickness | 0.025 inches | |
| Chart Device | Manual | |
| Collision | Yes | x |
| Delay Time | 5 seconds delay | |
| Break Sensitivity | 20 grams | x |
| Size Sample | See Table 2 | |
| Load divider | See Table 2 | |
| Sample Diameter | 3.50 inches | x |
| Pre-Tension* | 4.45 grams | |
| Sample shape | Circular | |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and to described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fibrous structure that exhibits a Geometric Mean Modulus of less than 865 at 15 g/cm as measured according to the Modulus Test Method and a Wet Burst of from 86 g to less than 355 g as measured according to the Wet Burst Test Method.

2. The fibrous structure according to claim 1 wherein the fibrous structure comprises cellulosic pulp fibers.

3. The fibrous structure according to claim 1 wherein the fibrous structure comprises a throughdried fibrous structure.

4. The fibrous structure according to claim 1 wherein the fibrous structure exhibits a Wet Burst of from about 86 g to about 300 g as measured according to the Wet Burst Test Method.

5. The fibrous structure according to claim 1 wherein the fibrous structure exhibits a Wet Burst of from 86 g to about 200 g as measured according to the Wet Burst Test Method.

6. The fibrous structure according to claim 1 wherein the fibrous structure exhibits a Geometric Mean Modulus of less than 800 at 15 g/cm as measured according to the Modulus Test Method.

7. The fibrous structure according to claim 1 wherein the fibrous structure exhibits a Geometric Mean Modulus of less than 750 at 15 g/cm as measured according to the Modulus Test Method.

8. The fibrous structure according to claim 1 wherein the fibrous structure comprises a softening composition.

9. The fibrous structure according to claim 8 wherein the softening composition comprises a silicone.

10. The fibrous structure according to claim 1 wherein the fibrous structure comprises a lotion composition.

11. The fibrous structure according to claim 1 wherein the fibrous structure is a sanitary tissue product.

12. The fibrous structure according to claim 11 wherein the sanitary tissue product exhibits a basis weight of greater than 15 g/m$^2$ to about 120 g/m$^2$ as measured according to the Basis Weight Test Method.

13. The fibrous structure according to claim 11 wherein the sanitary tissue product comprises a multi-ply sanitary tissue product.

14. A fibrous structure that exhibits a Geometric Mean Modulus of less than 1320 at 15 g/cm as measured according to the Modulus Test Method and a Wet Burst of from greater than 95 g to less than 355 g as measured according to the Wet Burst Test Method.

15. A multi-ply fibrous structure that exhibits a Geometric Mean Modulus of less than 865 at 15 g/cm as measured according to the Modulus Test Method and a Wet Burst of 86 g or greater as measured according to the Wet Burst Test Method.

16. A multi-ply fibrous structure that exhibits a Geometric Mean Modulus of less than 1320 at 15 g/cm as measured according to the Modulus Test Method and a Wet Burst of from greater than 95 g as measured according to the Wet Burst Test Method.

17. A fibrous structure that exhibits a CD Modulus of less than 710 at 15 g/cm as measured according to the Modulus Test Method and a Wet Burst of 86 g or greater as measured according to the Wet Burst Test Method.

18. The fibrous structure according to claim 17 wherein the fibrous structure comprises cellulosic pulp fibers.

19. The fibrous structure according to claim 17 wherein the fibrous structure comprises a throughdried fibrous structure.

20. The fibrous structure according to claim 17 wherein the fibrous structure exhibits a Wet Burst of 86 g to about 300 g as measured according to the Wet Burst Test Method.

21. The fibrous structure according to claim 17 wherein the fibrous structure exhibits a Wet Burst of 86 g to about 200 g as measured according to the Wet Burst Test Method.

22. The fibrous structure according to claim 17 wherein the fibrous structure exhibits a CD Modulus of less than 500 at 15 g/cm as measured according to the Modulus Test Method.

23. The fibrous structure according to claim 17 wherein the fibrous structure exhibits a CD Modulus of less than 425 at 15 g/cm as measured according to the Modulus Test Method.

24. The fibrous structure according to claim 17 wherein the fibrous structure comprises a softening composition.

25. The fibrous structure according to claim 24 wherein the softening composition comprises a silicone.

26. The fibrous structure according to claim 17 wherein the fibrous structure comprises a lotion composition.

27. The fibrous structure according to claim 17 wherein the fibrous structure is a sanitary tissue product.

28. The fibrous structure according to claim 27 wherein the sanitary tissue product exhibits a basis weight of greater than 15 g/m$^2$ to about 120 g/m$^2$ as measured according to the Basis Weight Test Method.

29. A fibrous structure that exhibits a CD Modulus of less than 875 at 15 g/cm as measured according to the Modulus Test Method and a Wet Burst of from 86 g to less than 175 g as measured according to the Wet Burst Test Method.

30. A multi-ply fibrous structure that exhibits a CD Modulus of less than 875 at 15 g/cm as measured according to the Modulus Test Method and a Wet Burst of 86 g or greater as measured according to the Wet Burst Test Method.

31. A multi-ply fibrous structure that exhibits a CD Modulus of less than 1320 at 15 g/cm as measured according to the Modulus Test Method and a Wet Burst of from greater than 95 g as measured according to the Wet Burst Test Method.

* * * * *